US005353577A

United States Patent [19]

Thurston

[11] Patent Number: 5,353,577

[45] Date of Patent: Oct. 11, 1994

[54] REVERSIBLE SADDLE PAD

[76] Inventor: Christene Thurston, 361 Sweetman Rd., Ballston Spa, N.Y. 12020

[21] Appl. No.: 106,044

[22] Filed: Aug. 12, 1993

[51] Int. Cl.[5] ..... B68C 1/12

[52] U.S. Cl. ..... 54/66

[58] Field of Search ..... 54/65, 66, 79.2

[56] References Cited

U.S. PATENT DOCUMENTS

| | | | |
|---|---|---|---|
| 97,295 | 11/1869 | Hogg | 54/66 |
| 189,694 | 4/1877 | Burgess | 54/65 |
| 224,468 | 2/1880 | Palmer . | |
| 313,714 | 3/1885 | Evans . | |
| 383,051 | 5/1888 | Gustaveson . | |
| 489,270 | 1/1893 | Schroeder | 54/66 |
| 742,701 | 10/1903 | Maussner | 54/65 |
| 2,072,188 | 3/1937 | Tauber | 54/66 |
| 3,807,136 | 4/1974 | Deal | 54/66 |

*Primary Examiner*—Robert P. Swiatek

*Attorney, Agent, or Firm*—Schmeiser, Morelle & Watts

[57] ABSTRACT

A reversible saddle pad having first and second opposing sides which may be alternately displayed under a saddle. An aperture is provided adjacent each saddle pad billet keeper for removably receiving the billet keeper therethrough.

8 Claims, 3 Drawing Sheets

REVERSIBLE SADDLE PAD

FIELD OF THE INVENTION

The present invention relates to protective apparel for animals and, more particularly, to a reversible covering adapted to be positioned between the back area of an animal and a saddle, harness or the like.

BACKGROUND OF THE INVENTION

As is well known in the equestrian field, a protective covering such as a blanket or pad (hereafter referred to as a saddle pad) is generally positioned between the back of a horse and a saddle to prevent the saddle from directly abrading the horse's hide. Typically, the saddle pad extends downward along the sides of the horse, and a large portion thereof is visible under the saddle. As such, many equestrian enthusiasts and professionals commonly utilize a saddle pad having a distinctive color scheme or design to identify their affiliation with a particular horse club or the like.

Conventional saddle pads generally include a first side which is designed to be secured against the underside of a saddle and a second, opposing side, which is adapted to be placed directly against the back area of a horse. Typically, the first side of the saddle pad includes a pair of permanently affixed and symmetrically disposed billet keepers for securing the saddle pad to the billets of a saddle. Analogously, the surface of the second side of the saddle pad is generally covered with a soft, comfortable, nonabrasive material, and is completely void of any attachments that may uncomfortably abrade the back area of the horse, potentially resulting in sores or other deleterious injuries. Consequently, to avoid injuring a horse, a saddle pad must always be worn with the billet keepers disposed on the outwardly-facing side thereof, adjacent the billets of the saddle.

Many equestrians are members of a plurality of horse clubs and/or participate in a wide variety of equestrian activities and, as such, oftentimes desire to vary the appearance of a saddle pad in accordance therewith. Unfortunately, due to the unipositional nature of conventional saddle pads, one must completely exchange saddle pads to alter the color scheme or design displayed under a saddle, thereby necessitating the purchase of a plurality of uniquely colored saddle pads.

SUMMARY OF THE INVENTION

In order to avoid the disadvantages of the prior art, the present invention provides a novel system for reversing a saddle pad, wherein either side of the saddle pad may be alternately displayed under a saddle.

The reversible saddle pad of the present invention includes first and second opposing sides, each formed from a soft, nonabrasive, fleece-type material which is adapted to be comfortably worn against the back of a horse, a pair of symmetrically disposed billet keepers, each including a first end portion which is fixedly attached to the saddle pad and a second, adjustable end portion for removably securing the saddle pad to the billets of a saddle, and a pair of apertures, each located adjacent the fixedly attached first end portion of a corresponding billet keeper and extending through the saddle pad between the first and second opposing sides thereof.

As in the prior art, the saddle pad of the instant invention is adapted to be positioned on a horse with the billet keepers disposed on a first, outwardly-facing, visible side thereof, wherein the second, inwardly-facing side of the saddle pad, adjacent the horse, is void of any potentially injurious attachments. When necessary, the saddle pad may be reversed by removably inserting and pulling each of the billet keepers through its adjacent aperture, from the first to the second side of the saddle pad. Advantageously, after the aforesaid reversal, the billet keepers are adapted to extend from the second side of the saddle pad, thereby allowing the second side of the saddle pad to be displayed under a saddle, with the first side of the saddle pad, which is now void of any attachments, safely positioned against the horse. To return the saddle pad to its original configuration, a user simply inserts and pulls each of the billet keepers through its adjacent aperture to the first side of the saddle pad.

BRIEF DESCRIPTION OF THE DRAWINGS

These and other features of the present invention will become readily apparent upon reading the following detailed description and upon reference to the drawings in which.

DETAILED DESCRIPTION OF THE INVENTION

Figure 1:
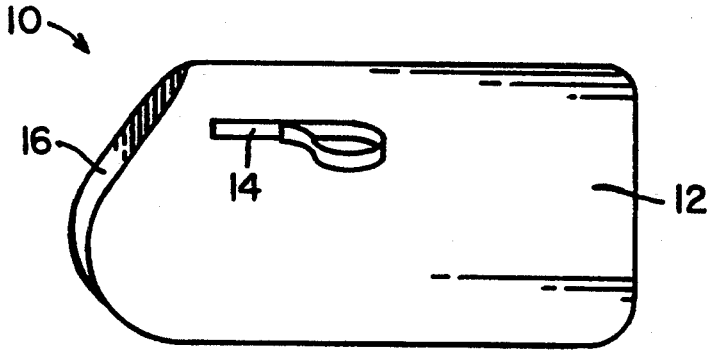
FIG. 1 PRIOR ART
FIG. 1 illustrates a conventional saddle pad.

Referring now specifically to the drawings, there is illustrated a reversible saddle pad, generally designated as 20, in accordance with the preferred embodiment of the present invention, wherein like reference numerals refer to like components throughout the drawings.

Figure 2:
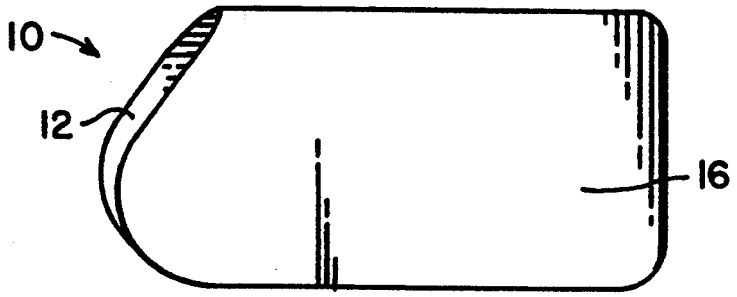
FIG. 2 PRIOR ART
FIG. 2 illustrates the opposing side of the conventional saddle pad of FIG. 1.

As illustrated in FIG. 1, a conventional saddle pad 10 typically includes a first side 12 having a pair of symmetrically disposed billet keepers 14 (only one shown) for securing the saddle pad to the billets of a saddle, and a second side 16 that is adapted to be placed directly against the back area of a horse. If one were to reverse the conventional saddle pad 10 to display a different color scheme or design under a saddle, as depicted in FIG. 2, the billet keepers 14 would rub against the horse, potentially resulting in undesirable injuries. Further, after reversal, the billet keepers 14 are concealed by the saddle pad and cannot be utilized to secure the saddle pad to the billets of a saddle. As such, the saddle pad will shift and/or bunch uncomfortably under the saddle, potentially resulting in injuries to the back and girth areas of a horse.

As illustrated in FIGS. 3 through 9, the reversible saddle pad 20 includes first and second opposing sides 22 and 24, respectively, each formed from a soft, non-abrasive, material. Preferably, two disparately colored layers of a fleece-type fabric are stitched together about the perimeter thereof 26 and along a centrally bisecting line 28.

A pair of symmetrically located, adjustable billet keepers 30 are provided to secure the saddle pad to a saddle. Each billet keeper 30 includes a first end portion which is fixedly attached to the saddle pad and a second, adjustable end portion for removably securing the saddle pad to the billets of a saddle.

The saddle pad 20 further includes a pair of apertures 32 which extend through the saddle pad between the first and second opposing sides 22, 24 thereof, wherein each of the apertures 32 is disposed adjacent the fixedly attached first end portion of a corresponding billet keeper 30.

Figure 5:
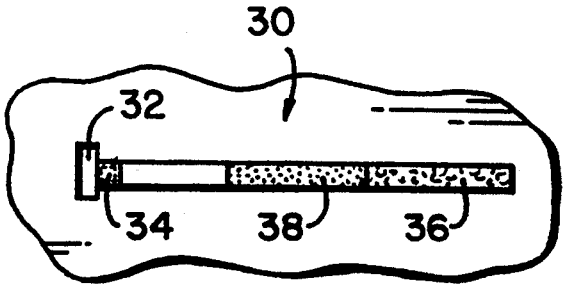
FIG. 5 is an enlarged view of a billet keeper and associated aperture.
Figure 6:
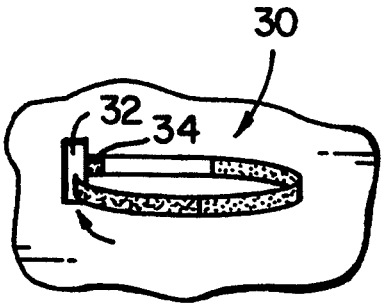
FIG. 6 is an enlarged view of a billet keeper as it is inserted and pulled through an adjacent aperture, during the reversal of the saddle pad.
Figure 3:
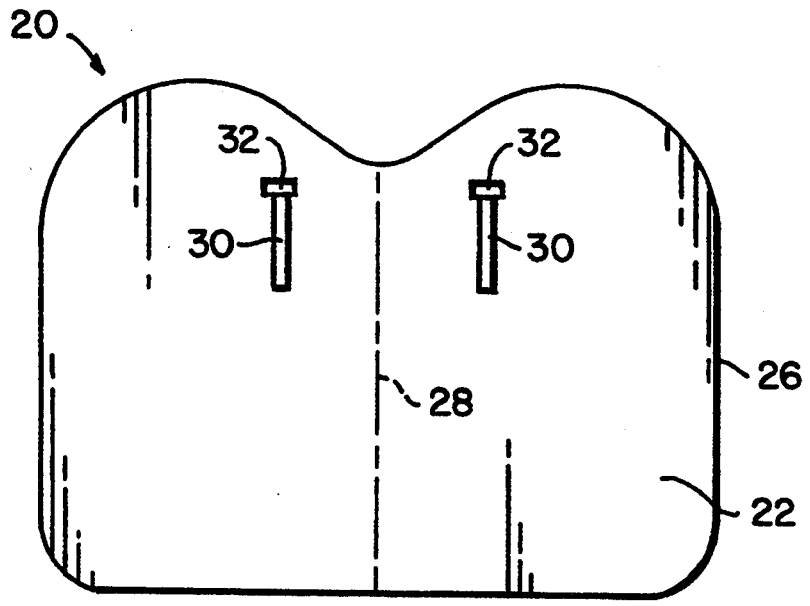
FIG. 3 is a plan view of a first side of a saddle pad according to the present invention.
Figure 4:
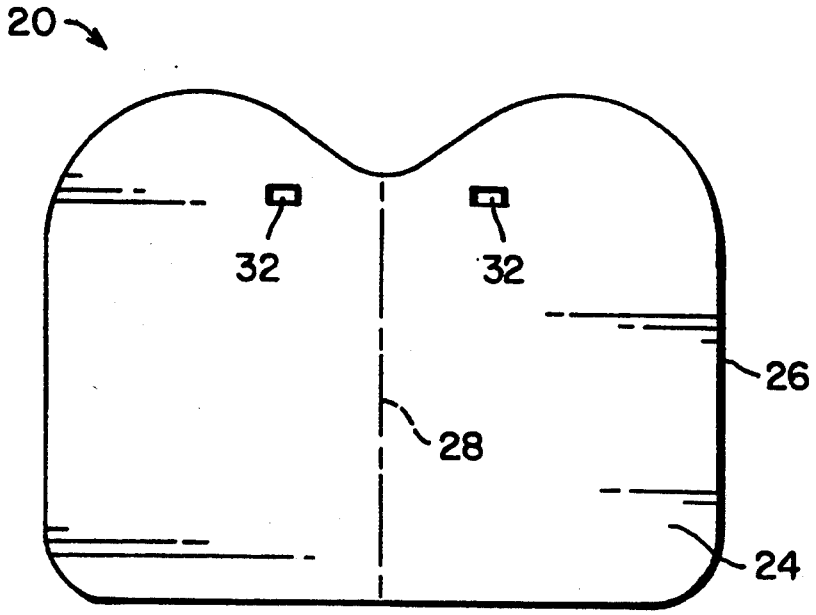
FIG. 4 is a plan view of the second, opposing side of the saddle pad illustrated in FIG. 3.
Figure 7:
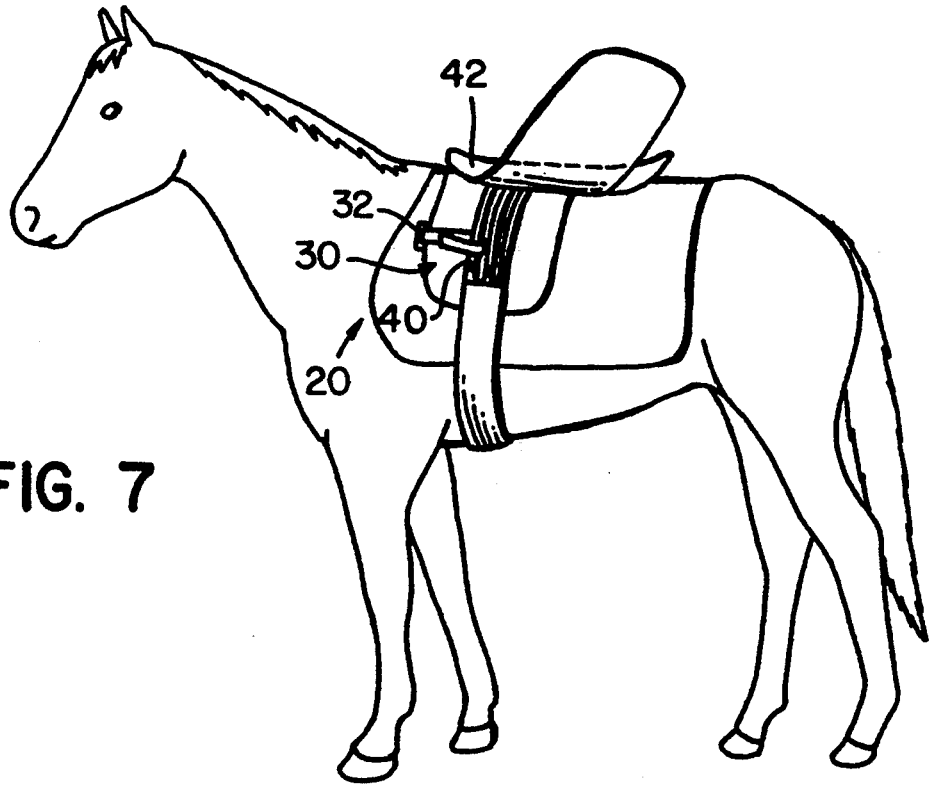
FIG. 7 is a perspective view of a horse having the saddle pad of the present invention mounted thereon under a saddle.

An enlarged view of a billet keeper 30 and its associated aperture 32 is provided in FIGS. 5 and 6. As indicated at 34, a first end portion of each billet keeper 30 is fixedly attached to the saddle pad 20 proximate aperture 32. The opposing, distal end portion of each billet keeper 30 includes a hook/loop-type closure element 36 which is adapted to be folded over against a mating section of loop/hook-type closure element 38, thereby forming a length adjustable loop which is adapted to be secured about the billet 40 of a saddle 42 (see FIG. 7). Advantageously, the adjustable billet keeper 30 allows the saddle pad 20 of the present invention to be utilized under a wide variety of saddle configurations.

Figure 8:
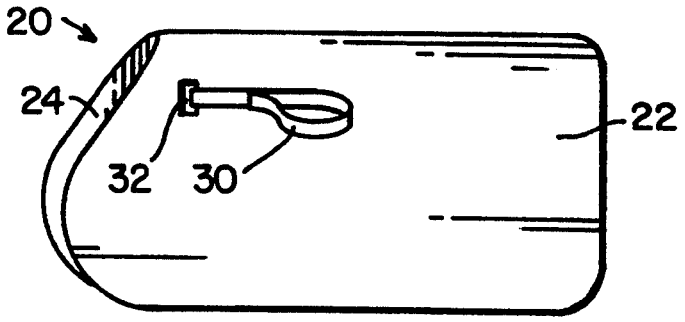
FIG. 8 illustrates the saddle pad of the present invention with a billet keeper extending from a first, outwardly-facing side thereof.
Figure 9:
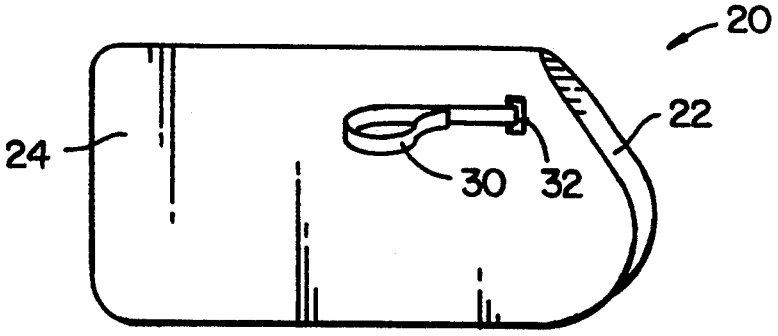
FIG. 9 illustrates the saddle pad of FIG. 8 after being reversed, with a billet keeper extending from the second, opposing side thereof.

Returning again to FIG. 6, the saddle pad 20 may be reversed as necessary by inserting and pulling each of the billet keepers 30 completely through its adjacent aperture 32, from a first to a second side of the saddle pad. To return the saddle pad 20 to its original configuration, a user must simply reinsert and pull each of the billet keepers in the reverse direction through its adjacent aperture 32, from the second to the first side of the saddle pad. Thus, as shown in FIGS. 8 and 9, a single saddle pad 20 may be easily reversed, thereby allowing either of the opposing sides 22 and 24 to be alternately displayed under a saddle.

The foregoing description of the preferred embodiments of the invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

I claim:

1. A reversible saddle pad comprising:

a fabric pad having first and second opposing sides;

a pair of straps extending from the first said of said fabric pad;

means for permanently attaching a first end portion of each strap to said fabric pad; and means for removably attaching a second end portion of each strap to a saddle, wherein said fabric pad is adapted to be interposed between said saddle and an animal and wherein the second side of said fabric pad is adapted to be positioned against said animal;

said fabric pad further including means for removably receiving the second end portion of each strap therethrough with said straps extending from the second side of said fabric pad, thereby allowing the first side of said fabric pad to be reversibly positioned against said animal, said receiving means extending between the first and second sides of said fabric pad.

2. The reversible saddle pad according to claim 1 wherein said means for removably receiving includes a pair of apertures, wherein each of said apertures is adapted to receive the second end portion of one of said straps therethrough, each of said apertures being disposed in said fabric pad proximate the first end portion of one of said straps and extending through said fabric pad between the first and second opposing sides thereof.

3. The reversible saddle pad according to claim 1 wherein the second end portion of each strap includes means for forming a size-adjustable loop.

4. The reversible saddle pad according to claim 3 wherein said means for forming a size-adjustable loop includes a hook and loop type fastening element.

5. A reversible saddle pad comprising:

a fabric pad having first and second opposing sides and a pair of billet keeper straps;

means for permanently attaching a first end portion of each billet keeper strap to said fabric pad; and means for removably attaching a second end portion of each billet keeper strap to a billet on a saddle;

said fabric pad further including means for removably receiving the second end portion of each billet keeper strap therethrough, said receiving means extending between the first and second sides of said fabric pad.

6. The reversible saddle pad according to claim 5 wherein said means for removably receiving includes a pair of apertures, wherein each of said apertures is adapted to receive the second end portion of one of said billet keeper straps therethrough, each of sad apertures being disposed in said fabric pad proximate the first end portion of one of said billet keeper straps and extending through said fabric pad between the first and second opposing sides thereof.

7. The reversible saddle pad according to claim 5 wherein the second end portion of each billet keeper strap includes means for forming a size-adjustable loop.

8. The reversible saddle pad according to claim 7 wherein said means for forming a size-adjustable loop includes a hook and loop type fastening element.

* * * * *